United States Patent [19]

Pentith

[11] 4,072,355

[45] Feb. 7, 1978

[54] FLUID SUPPLY DUCT AND PICKUP FOR MINING MACHINES

[75] Inventor: Gerald Richard Oldham Pentith, Barnsley, England

[73] Assignee: Summit Mining Ltd., Barnsley, England

[21] Appl. No.: 708,379

[22] Filed: July 26, 1976

[30] Foreign Application Priority Data

July 26, 1975 United Kingdom ..... 31386/75
July 26, 1975 United Kingdom ..... 31387/75

[51] Int. Cl.[2] ..... E21C 35/08; E21C 35/22

[52] U.S. Cl. ..... 299/43; 104/161; 137/580; 239/183; 299/12

[58] Field of Search ..... 299/12, 34, 43, 42; 239/183; 137/580; 104/157–159, 161

[56] References Cited

U.S. PATENT DOCUMENTS

| | | | |
|---|---|---|---|
| 3,722,424 | 3/1973 | Veldhuizen | 104/161 |
| 3,861,751 | 1/1975 | Erwien | 299/43 |

*Primary Examiner*—Ernest R. Purser
*Attorney, Agent, or Firm*—Olson, Trexler, Wolters, Bushnell & Fosse, Ltd.

[57] ABSTRACT

A duct for use with mine equipment is provided with an elongate aperture normally closed by a displaceable sealing means to retain a fluid, under pressure, within the duct, the sealing means, in use, being displaceable by fluid pick-up means carried by a mining machine to convey fluid from the duct to the machine. The invention also includes conveyor trough section provided with such a duct and a mining machine combination.

9 Claims, 3 Drawing Figures

1
4
6
9
10
11
12
13
14
15
16
19
20
21
23
24
26
31
32
33
34
35
36
37
38
39

FLUID SUPPLY DUCT AND PICKUP FOR MINING MACHINES

This invention relates to ducts for mine equipment and mining machines.

There has been proposed in co-pending Application Ser. No. 574948 a conduit for use with a mining machine, the conduit being pressurized with relatively clean air or an inert gas to a pressure higher than the air pressure outside the conduit, with a flexible sealing means closing an elongate slot and displaceable by electrical pickup means carried by the machine. This arrangement is to retain in a safe condition the electrical equipment e.g. copper conductors, pantographs, contained within the conduit which, in the case of coal mining operations, maintains the electrical equipment free of coal dust, water, methane etc., and hence flameproof. The mining machine is mounted on and/or guided by an armoured face conveyor, collecting electrical power from within the conduit, and carries at least one mineral cutting means. One such means used extensively in British coal mines is a spiral vane shearer disc or drum which comprises a helical vane or vanes carrying coal cutter picks, the vane(s) being mounted on a cylindrical body member and employed not only to cut the mineral, but also to assist in loading the mineral, by the helical action of its vane(s), onto the conventional armoured face conveyor. It is also known to employ cowls and ploughs to improve mineral loading, and it is also known to provide the cutting means and/or the cowls with water spray jets to direct water to the vicinity of cutting, for safety purposes, in order to bring down as much as possible the resulting dust. Supply of water to the machine has conventionally been provided by water pipes or "bagging" extending along the goaf side of the conveyor and contained in a trough between spill plates to avoid damage to the pipes during advance of conventional, hydraulically powered, selfadvancing roof supports provided along the goaf side of the conveyor, and also to keep the pipes off the conveyor as they are pulled from, and re-laid into, the trough as dictated by the movement of the machine along the conveyor.

Apart from the longwall type of mining machine as described above, there are also "shortwall" machines that are usually crawler mounted on endless tracks, as well as machines for driving tunnels or mine roadways, and all such machines are to be understood as embraced by the term "mining machine" used herein.

According to a first aspect of the present invention a duct for use with mine equipment is provided with an elongate aperture normally closed by a displaceable sealing means to retain a fluid, under pressure, within the duct, the sealing means, in use, being displaceable by fluid pick-up means carried by a mining machine to convey fluid from the duct to the machine.

According to a second aspect of the present invention, mine equipment comprises a conveyor trough section, adapted, in use, to be joined end to end with similar sections to form an armoured conveyor, provided with a duct having an elongate aperture normally closed by a displaceable sealing means to retain a fluid, under pressure, within the duct, the sealing means, in use, being displaceable by fluid pick-up means, carried by a mining machine adapted to be located on the conveyor, to convey fluid from the duct to the machine.

In accordance with a third aspect of the present invention, there is provided a mining machine having means for conducting the fluid from a duct or conduit to the vicinity of mineral cutting, the duct or conduit having an elongate aperture normally closed by a displaceable sealing means to retain a fluid under pressure, within the duct, the sealing means, in use, being displaceable by fluid pick-up means carried by a mining machine to convey fluid from the duct to the machine.

The fluid may be water, air or an inert gas. If both water and air or inert gas are required two similar ducts may be provided one for each fluid medium.

Thus the duct of the present invention may be used in conjunction with the conduit of co-pending application Ser No. 574,948 to provide mining equipment that, in accordance with previous proposals firstly requires no haulage chain, secondly requires no electrical supply cables and finally, requires no supply pipes for water etc. In respect of air or inert gas, the expression "under pressure" is to be taken as meaning at a pressure greater than the air pressure outside the duct.

Whilst water is for dust suppression purposes, the air or inert gas supplies are a means of readily supplying clean air or inert gas to e.g. a coal face so as to dilute methane released at the coal face. However, in accordance with a preferred feature of the invention, the supply of clean air or inert gas is first fed into a venturi tube or jet pump, so that water and/or more air is entrained and thereafter released with the clean air or inert gas in the vicinity of cutting.

Water collected from the duct by the pick-up means of the mining machine is conveyed by suitable piping to conventional spray nozzles provided on a cutting means e.g. adjacent cutter picks, and/or any cowl that may be carried by the machine. The means for conducting the fresh air or inert gas from the conduit may comprise an air supply pipe that passes through the flexible sealing means of the conduit, at the same point as the electrical pick-up means of the mining machine through the sealing means.

Preferably, the sealing means is pressurized, which may be realised by closing the elongate aperture or gap by a pair of abutting, air inflated tubes. Alternatively the tubes may be solid, or substantially so, or pressurized with water.

The duct of the invention may be provided in unit lengths e.g. corresponding to the lengths of the individual pan sections that make up an armoured conveyor, with water tight connections e.g. of rubber, between adjacent duct lengths. In detail, the duct may comprise an outer sheet metal casing, of elongate configuration, having an open elongate slot, which houses flexible ducting material e.g. of rubber or synthetic plastics, formed into a general U-shape, with integral sealing means e.g. inflatable tubes at the upper ends of the arms of the "U".

Whilst it is necessary to provide a separate water duct to obtain water supplies, it is not essential to provide a separate air duct if one employs the conduit described in co-pending Application Ser. No. 574,948, whereby air or inert gas supplies may be obtained from the conduit.

The invention will now be described in greater detail, by way of example with reference to the accompanying drawings in which.

Figure 1:
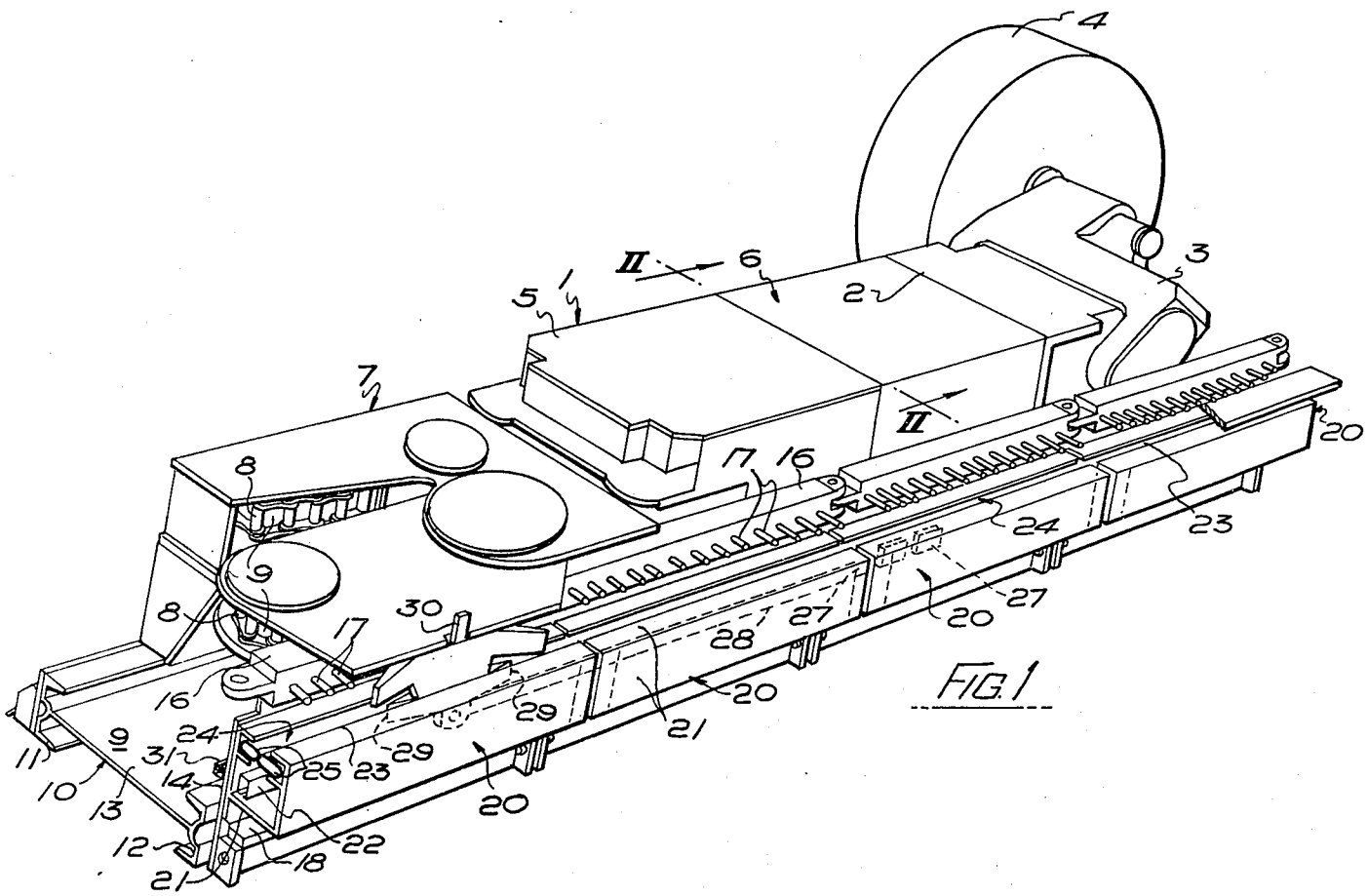
FIG. 1 is a perspective view of a mining machine and machine equipment in accordance with the invention.

In the drawings, a mining machine 1 of the single ended ranging down shearer type, is provided at one end with a gearhead 2 to which is pivotally attached an arm 3 carrying a rotatable shearer drum 4 (spiral vanes and cutter picks thereof not being shown), a central power unit 5 housing an electric motor (not shown) a gearbox 6 and a haulage unit 7 having an endless haulage chain 8 passing around a plurality of sprockets (not shown) at least one being a drive sprocket.

Figures 2, 3:
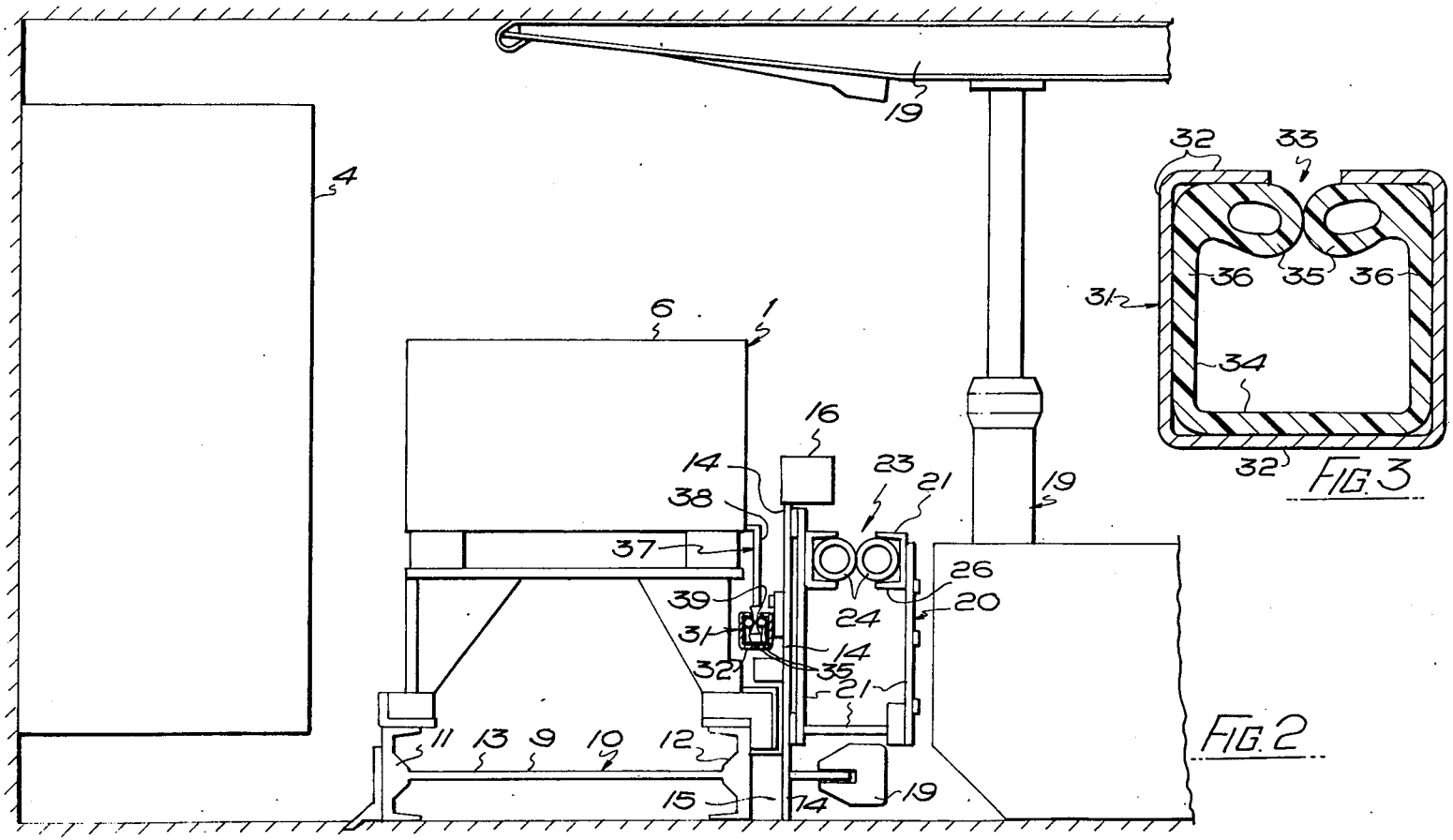
FIG. 2 is a section on the line II — II of FIG. 1.
FIG. 3 is an enlarged view of the duct cross-section of FIG. 2.

The machine 1 is mounted on and guided by trough sections 9 of an armoured conveyor 10, each section having a face-side sidewall 11 and a goaf-side sidewall 12, the sidewalls being connection by a deck plate 13. A support plate 14 is attached at the sidewall 12, via spacer blocks 15 (FIG. 2). At the upper end of each support plate 14 is supported one or more rack bars 16 housing reciprocable pegs 17 for the mining machine 1. The haulage system of this mining installation may be of the form described in U.S. Pat. No. 3,753,696 i.e. the pegs may be reciprocated into the chain 8. Alternatively, the pegs 17 could be fixed. Towards the lower end of each support plate 14 is secured a clevis rail 18 for attachment in the usual manner via a relay bar to the advancing rams (not shown) of conventional, hydraulically powered, self-advancing mine roof support 19. A conduit 20, of generally U-section formed from top, bottom and side plates 21, is secured to the support plates 14, beneath the rack bars 16 and the conduit is provided with a plurality of elongate copper conductors 22 while the conduit of each trough section 9 is also provided with a longitudinally extending entry slot 23 in the top plate 21 closed by a flexible sealing means 24 constituted by a pair of inflated tubes 25, adjacent peripheries thereof abutting one another, each tube 25 being located between top plate 21 and an intermediate plate 26. A pick up means consituted by two spaced pantographs 27, incorporating suitable brush gear, extending on an arm 28 from the machine, enters the slot 23, which pantographs move with the machine 1 along the conveyor 11. The pantographs 27 are located at one end of the towing arm 28 that extends longitudinally within the conduit and terminates at a double ended entry wedge 29 to part the tubes 25. With the arm 28 extend the necessary cables 30 conveying power from the conductors 22 to the conventional electric motor of the machine 1.

To the other side of the support plate 14 from the conduit 20 is secured a duct 31. The duct is made up in sections corresponding in length to the trough sections 9, with the ends of adjacent duct sections suitably sealed. The duct comprises an outer sheet metal casing 32 formed with a general U-shape having an entry slot 33. Within the casing 32 is housed rubber ducting 34, also formed to general U-shape with an integral sealing means in the form of inflatable tubes 35 at the upper ends of arms 36 of the ducting 34. Within the ducting 34 is contained water under pressure and from the machine 1 extends a means 37 to effect water pick up. The means 37 comprises a pipe 38 and a double-ended entry wedge 39 to part the tubes 35. Water is conveyed from the pipe 38 to the vicinity of the cutter picks of the drum 4 and also to cool the electric motor of the central power unit 5.

Although in FIG. 1, the sprockets of the endless chain 8 are indicated as rotatable about substantially vertical axes, they could be rotatable about substantially horizontal axes, with the pegs 17 projecting upwardly. Again the chain 8 may be provided with teeth to engage pockets of the rack bars.

What I claim is:

1. A supply duct for use with mining equipment, or the like, to supply fluid to said equipment in the absence of trailing hoses in the vicinity of operation of said equipment, said supply duct comprising, in combination, an outer channel-like casing having an elongate opening formed in a wall portion thereof, an inner casing of a channel-like configuration formed for a material impervious to said fluid, and disposed within said outer casing to in effect line the inner walls thereof, said inner casing including an elongate, normally sealed slot formed therein and aligned with said elongate opening in said outer channel-like casing, said normally sealed slot being defined by opposed, resilient inner casing portions, the resiliency of which maintains said portions in engagement to seal said slot, while permiting said portions to be displaced, such as by a fluid pickup means, to permit entry thereof to the interior of said inner casing with said resilient portions engaged about said fluid pickup means to maintain said seal, whereby said fluid pickup means may be moved along the length of said duct in communication with fluid being transported therein, without disruption of the sealed engagement of said inner casing portions, except proximate said fluid pickup means.

2. A duct assembly according to claim 1 wherein said resilient, engaged inner casing portions include tubelike portions which define plenum chambers, whereby air may be introduced into said chambers to maintain said sealed engagement.

3. A duct assembly according to claim 1, wherein there is provided a plurality of said inner and outer casings combinations joined together to provide said duct assembly, and sealing means providing a sealed joint between the interconnected inner casings of each combination.

4. A fluid supply system for a mining machine, or the like, wherein fluid is to be supplied to said machine in the absence of hoses in the vicinity of said machine, said supply system comprising, a duct assembly for transporting said fluid to the vicinity of said machine, and fluid pickup means disposed in said duct assembly and operably connected to said machine, said duct assembly including an elongate, normally sealed opening extending parallel to the path of movement of said machine, said opening being closed by a pair of resilient sealing members, the resiliency of said members maintaining them in engagement, but permitting displacement thereof by said fluid pickup means, such that said fluid pickup means may be disposed in said duct through said opening in communication with said fluid, and said pickup means can move with said machine along said duct with said resilient sealing members maintaining a seal about said fluid pickup means during said movement.

5. A fluid supply system according to claim 4, wherein said duct assembly include an outer channel-like casing having an elongate opening formed therein, an inner casing of a channel-like configuration formed of a material impervious to said fluid, said inner casing being disposed within said outer casing and including an elongate, normally sealed slot aligned with said elongate opening of said outer casing, said normally sealed, elongate slot being defined by opposed resilient casing portions, the resiliency of which maintains said portions in engagement to effect said seal, with said portions being displaceable to permit the disposition of said fluid pickup means in said duct assembly and thereby defining said resilient sealing members for said duct assembly.

6. A fluid supply system according to claim 5, wherein said resilient casing portions include tube-like sections defining a plenum chamber such that air may be introduced into said plenum chamber to inflate said resilient casing portions thereby to maintain said sealed engagement thereof.

7. A mining machine comprising mineral cutting means, a system for supplying fluid to the vicinity of said mineral cutting, and fluid supply means operably connected to a source of fluid and to said system for supplying fluid to the vicinity of said mineral cutting, said supply means comprising a duct assembly for transporting said fluid to the vicinity of the operation of said machine, and fluid pickup means carried by said machine and disposed in said duct assembly and operably connected with said system, said duct assembly including an elongate, normally sealed opening extending generally parallel to the path of movement of said machine, said opening being closed by a pair of resilient sealing members, the resiliency of said members maintaining them in engagement, but permitting displacement thereof by said fluid pickup means such that said fluid pickup means will be disposed in contact with the fluid within said duct, and is movable along the length of said duct upon movement of said machine, with said resilient sealing members maintaining a seal about the fluid pickup means during said movement, and thereby maintaining the seal along the length of said elongate duct opening.

8. A mining machine according to claim 7, wherein said duct assembly include an outer channel-like casing having an elongate opening formed therein, an inner casing of a channel-like configuration formed of a material impervious to said fluid, said inner casing being disposed within said outer casing and including an elongate, normally sealed slot aligned with said elongate opening of said outer casing, said normally sealed, elongate slot being defined by opposed resilient casing portions, the resiliency of which maintains said portions in engagement to effect said seal, with said portions being displaceable to permit the disposition of said fluid pickup means in said duct assembly, and thereby defining said resilient sealing members for said duct assembly.

9. A mining machine according to claim 8, wherein said resilient casing portions include tube-like sections defining a plenum chamber such that air may be introduced into said plenum chamber to inflate said resilient casing portions thereby to maintain said sealed engagement thereof.

* * * * *